US007510452B2

(12) United States Patent
Van Tol et al.

(10) Patent No.: US 7,510,452 B2
(45) Date of Patent: Mar. 31, 2009

(54) DISCONNECTABLE MOORING SYSTEM FOR A VESSEL

(75) Inventors: Huibert Van Tol, Hoofddorp (NL); Rudolf Laurens Lolkes De Beer, Alphen Aan Den Rijn (NL); Pieter Cornelis Burger, Zoetermeer (NL); Johannes Cornelis Perdijk, Voorburg (NL)

(73) Assignee: Bluewater Energy Services B.V., HR Hoofddorp (NL)

( * ) Notice: Subject to any disclaimer, the term of this patent is extended or adjusted under 35 U.S.C. 154(b) by 28 days.

(21) Appl. No.: 11/617,948

(22) Filed: Dec. 29, 2006

(65) Prior Publication Data

US 2007/0155259 A1 Jul. 5, 2007

(30) Foreign Application Priority Data

Jan. 3, 2006 (EP) ..... 06100052

(51) Int. Cl.
*B63B 22/02* (2006.01)

(52) U.S. Cl. ..... 441/5

(58) Field of Classification Search ..... 441/3–5; 114/230.1

See application file for complete search history.

(56) References Cited

U.S. PATENT DOCUMENTS 4,604,961 A 8/1986 Ortloff ..... 114/230
4,892,495 A * 1/1990 Svensen ..... 441/5
5,363,789 A 11/1994 Laurie et al. ..... 114/293
5,431,589 A * 7/1995 Corona ..... 441/4
5,823,131 A * 10/1998 Boatman et al. ..... 114/230.12

FOREIGN PATENT DOCUMENTS

GB 2285028 6/1995

* cited by examiner

*Primary Examiner*—Stephen Avila
(74) *Attorney, Agent, or Firm*—Steven M. Koehler; Westman, Champlin & Kelly, P.A.

(57) ABSTRACT

A disconnectable mooring system for a vessel comprises a mooring buoy member and a turret structure mounted in a moonpool of the vessel. The mooring buoy member is anchored to the seabed and has a plurality of passages each adapted to receive a riser. The turret structure has a receptacle for receiving the buoy member and a locking device for locking the buoy member in the receptacle. The turret structure accommodates a plurality of conduits to be connected to risers installed in passages of the buoy member and the turret structure is rotatably supported in the moonpool of the vessel by at least a bearing assembly mounted above sea level. The buoy member is provided with a conical outer casing and the receptacle of the turret structure has a cone shape corresponding to the conical outer casing of the buoy member. The turret structure comprises a turntable carrying the conduits to be connected to the risers. The turntable is supported on the bearing assembly in a manner allowing rotation with respect to the turret structure to align the conduits with the risers when the buoy member is received and locked in the receptacle of the turret structure. Additionally or alternatively, each conduit may comprise a lower part movable with respect to the turret structure to align the lower part with the corresponding riser.

22 Claims, 13 Drawing Sheets

36
37
38
35
34
39

33
32

DISCONNECTABLE MOORING SYSTEM FOR A VESSEL

BACKGROUND

The discussion below is merely provided for general background information and is not intended to be used as an aid in determining the scope of the claimed subject matter.

Aspects of the invention relate to a disconnectable mooring system for a vessel, comprising a mooring buoy member and a turret structure mounted in a moonpool of the vessel, the mooring buoy member being anchored to the seabed and having a plurality of passages each adapted to receive a riser, the turret structure having a receptacle for receiving the buoy member and locking device for locking the buoy member in the receptacle, the turret structure accommodating a plurality of conduits to be connected to risers installed in passages of the buoy member, wherein the turret structure is rotatably supported in the moonpool of the vessel by means of at least a bearing assembly mounted above sea level.

A disconnectable mooring system of this type is disclosed in GB-A-2 285 028. In this known mooring system, the mooring buoy member is provided with a centering projection to be received in a receiving entry of the receptacle of the turret structure. This construction requires a relatively accurate prepositioning of the buoy member and the receptacle during a mooring or connection operation. Further, the conduits accommodated in the turret structure need to be aligned with the risers of the buoy member before locking the buoy member in the receptacle. The conduits are terminated in the receptacle by movable sleeves which can be retracted within the receptacle to protect the sealing rings during connecting or disconnecting the buoy member. The movable sleeves need to be sealed with respect to the stationary conduits, resulting in a more complex and vulnerable construction.

In the disconnectable mooring system according to GB-A-2 285 028, the receptacle of the turret structure is located at the level of the vessel keel, wherein all engaging faces of the conduits, receptacle, risers and buoy member are located outside of the turret structure. Inspection of the engaging faces and sealings is impossible when the buoy member is at its location in the receptacle.

U.S. Pat. No. 4,604,961 discloses a disconnectable mooring system for a vessel, wherein the buoy member is provided with a conical outer casing which is received in a turret with a corresponding conical shape. This known mooring system only allows to the connection of one central riser with one central conduit mounted in the moonpool of the vessel. The bearing assembly rotatably supporting the turret in the moonpool is located below sea level. Further, the buoy member supports the locking device for locking the buoy member in the receptacle. This means that the bearing assembly and locking device with its operating mechanism are continuously exposed to the seawater environment.

SUMMARY

This Summary and the Abstract are provided to introduce some concepts in a simplified form that are further described below in the Detailed Description. The Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

A disconnectable mooring system includes a buoy member that is provided with a conical outer casing and a receptacle of the turret structure has a cone shape corresponding to the conical outer casing of the buoy member. The turret structure includes a turntable carrying conduits to be connected to the risers, wherein the turntable is supported on a bearing assembly in a manner allowing rotation with respect to the turret structure to align the conduits with the risers when the buoy member is received and locked in the receptacle of the turret structure.

In this manner a disconnectable mooring system is obtained, wherein the mooring operation is relatively simple as the conical outer casing of the buoy member allows an easy gradual positioning of the buoy member in the cone shape of the receptacle of the turret structure. As the turntable supports the conduits, the buoy member can be locked in the receptacle and the conduits can be aligned with the risers by rotation of the turntable. With the disconnectable mooring system the mooring operation of the vessel on the mooring buoy member requires a restricted time only.

Each conduit may comprise a lower part movable with respect to the turret structure to align the lower part with the corresponding riser. This embodiment compensates for tolerances in pitch and radial position of the risers and conduits. As an alternative this embodiment can be used without a rotatable turntable. In that case a rough prepositioning of the turret structure and turntable with respect to the buoy member will be used. The accuracy of the prepositioning will depend on the range within which the conduits are movable with respect to the risers.

According to an embodiment of the invention, the buoy member includes an upper end with an annular locking shoulder adapted to cooperate with the locking device of the turret, said locking device comprising a plurality of locking fingers distributed around the annular locking shoulder, each locking finger being movable by means of an operating mechanism, for example an actuator such as a hydraulic actuator, between a locking position engaging the annular locking shoulder and a rest position in which the annular locking shoulder can pass the locking fingers, wherein said operating mechanism can be mounted in the turret structure. In this manner the operating mechanism is protected from the seawater environment when the buoy member is received and locked in the receptacle of the turret structure.

According to an embodiment each riser is supported in the buoy member by means of a support which is movable up and down between a rest position and a work position, wherein each riser is provided with a connection flange which is located below the upper end of the buoy member in the support rest position and projects out of the upper end of the buoy member in the support work position. In this manner the connection flanges of the risers are protected by the upper end of the buoy member during a connection/disconnection operation.

In a further embodiment of the invention, a sealing device is provided between the buoy member and the receptacle cone of the turret structure to seal the inner side of the turret structure against seawater ingress when the buoy member is received and locked in the receptacle cone, wherein the passages and installed risers are located within the sealing device and are accessible through the turret structure when the buoy member is received and locked in the receptacle of the turret structure. This embodiment allows access to the risers and conduits located in the turret structure, so that the connection flanges can be prepared for coupling in order to guarantee a fully sealed coupling. Moreover, in case passages are still available for future installation of further risers, these risers can be installed while maintaining the buoy member in the locked position in the receptacle of the turret structure so that production through already installed production risers need not be interrupted.

Other aspects of the invention include a turret structure and buoy member to be used in the disconnectable mooring system.

Moreover, another aspect of the invention provides a vessel comprising such a turret structure.

Finally, a method for connecting a vessel to a mooring buoy member is provided. The vessel includes a turret structure having a receptacle for receiving the buoy member and a locking device for locking the buoy member in the receptacle, the mooring buoy member being anchored to the seabed and having a plurality of passages each adapted to receive a riser, the turret structure accommodating a plurality of conduits to be connected to risers installed in passages of the buoy member, wherein the buoy member is pulled into the receptacle cone and the locking device is activated to lock the buoy member in the receptacle cone. After locking the buoy member in the receptacle cone, the conduits are aligned with the corresponding risers by rotating a turntable carrying the conduits.

BRIEF DESCRIPTION OF THE DRAWINGS

Aspects of the invention will now be explained in more detail with reference to the drawings schematically showing two embodiments of the disconnectable mooring system.

DETAILED DESCRIPTION

Figure 1:
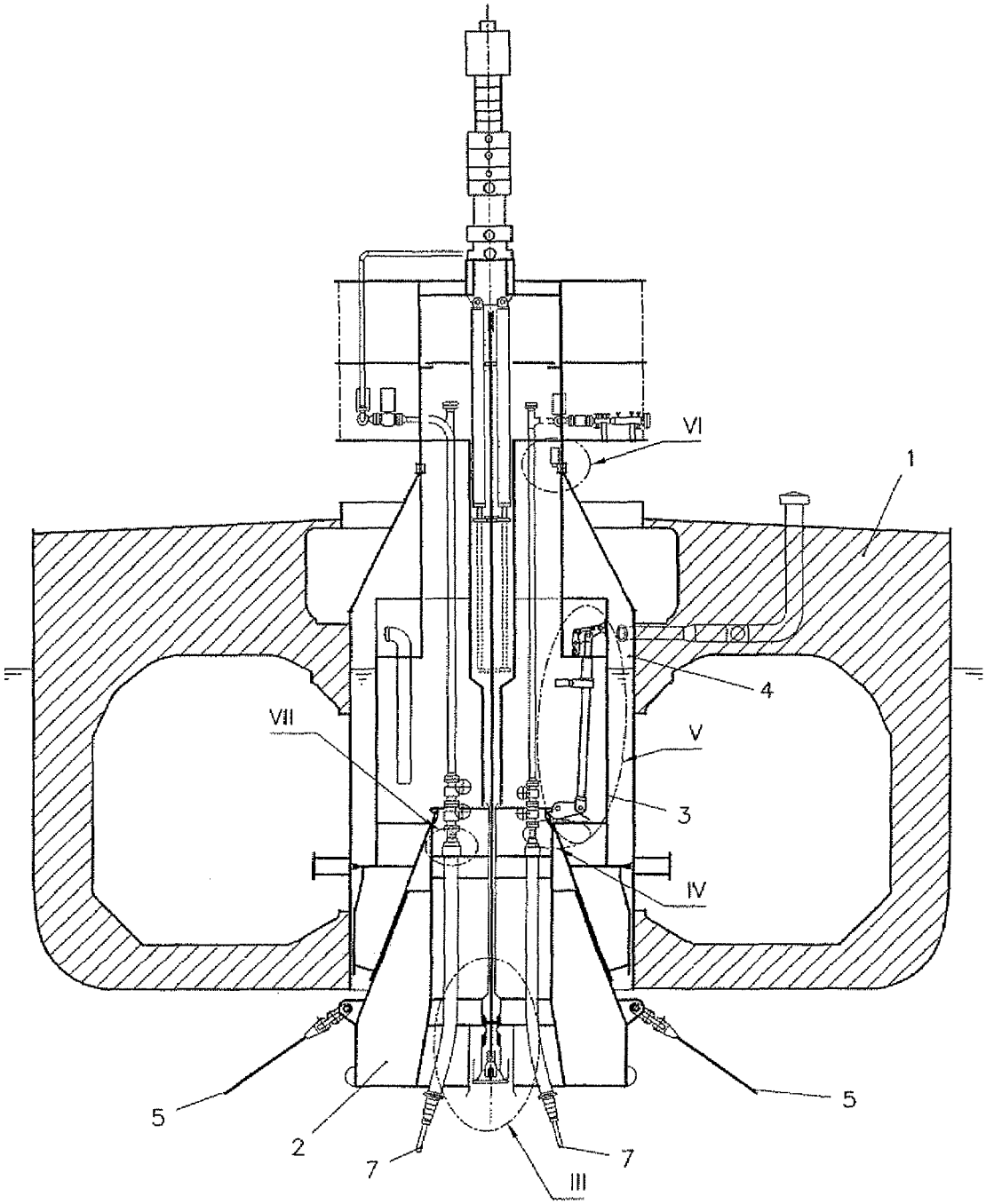
FIG. 1 shows a cross-section of a vessel comprising a first embodiment of the disconnectable mooring system, wherein the mooring buoy member is received and locked in the receptacle of the turret structure.
Figure 2:
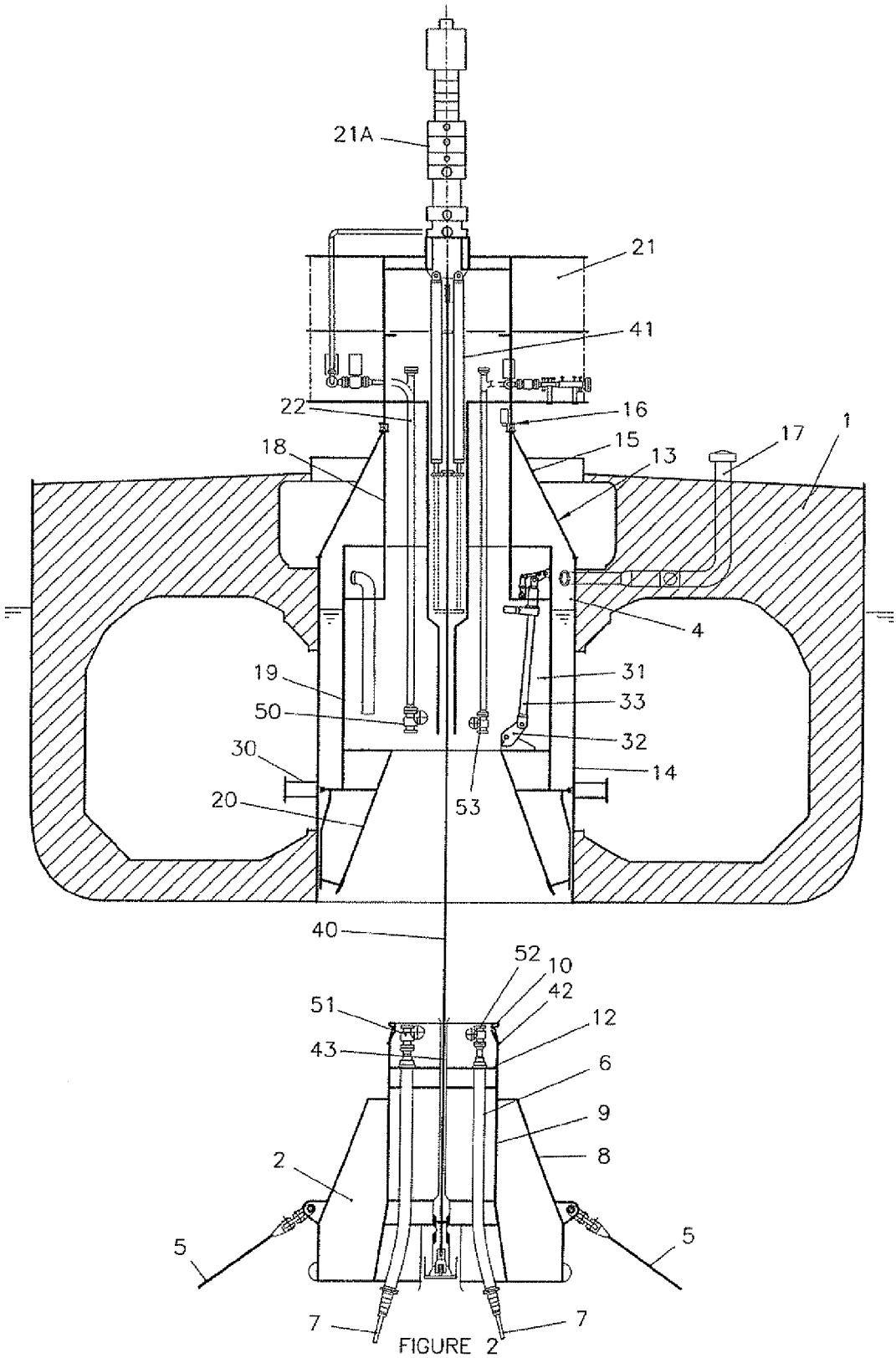
FIG. 2 shows the vessel with disconnectable mooring system of FIG. 1, wherein the mooring buoy member is disconnected from the receptacle of the turret structure.

FIGS. 1 and 2 schematically show a cross-section of a floating vessel 1, wherein FIG. 1 shows a mooring system in its connected condition and FIG. 2 shows the mooring system in a disconnected condition. In this embodiment the floating vessel 1 is a FPSO (Floating Production Storage of Loading) vessel. However, it will be understood that the disconnectable mooring system can be used in other types of vessels including floating F(P)SO objects.

The disconnectable mooring system comprises a mooring buoy member 2 and a turret structure 3 mounted in a moonpool 4 of the vessel 1. The buoy member 2 is designed for a submerged floating equilibrium at a predetermined level below seawater level, wherein the buoyancy capacity of the buoy member 2 is sufficient to accommodate the load of risers and mooring lines connected to the buoy member 2. The buoy member 2 is anchored to the seabed in a usual manner by mooring lines 5, two of which are shown in FIGS. 1 and 2. Further, the mooring buoy member 2 is provided with plurality of passages 6, each of which is adapted to receive a riser 7. For the sake of clarity only two risers 7 are shown in FIGS. 1 and 2. Each riser 7 can be any fluid or gas riser or an umbilical riser. Each passage 6 with or without riser 7 is sealed by sealing elements or closure elements to prevent seawater ingress into the turret structure when the buoy member is received and locked in the turret structure.

Figure 4:
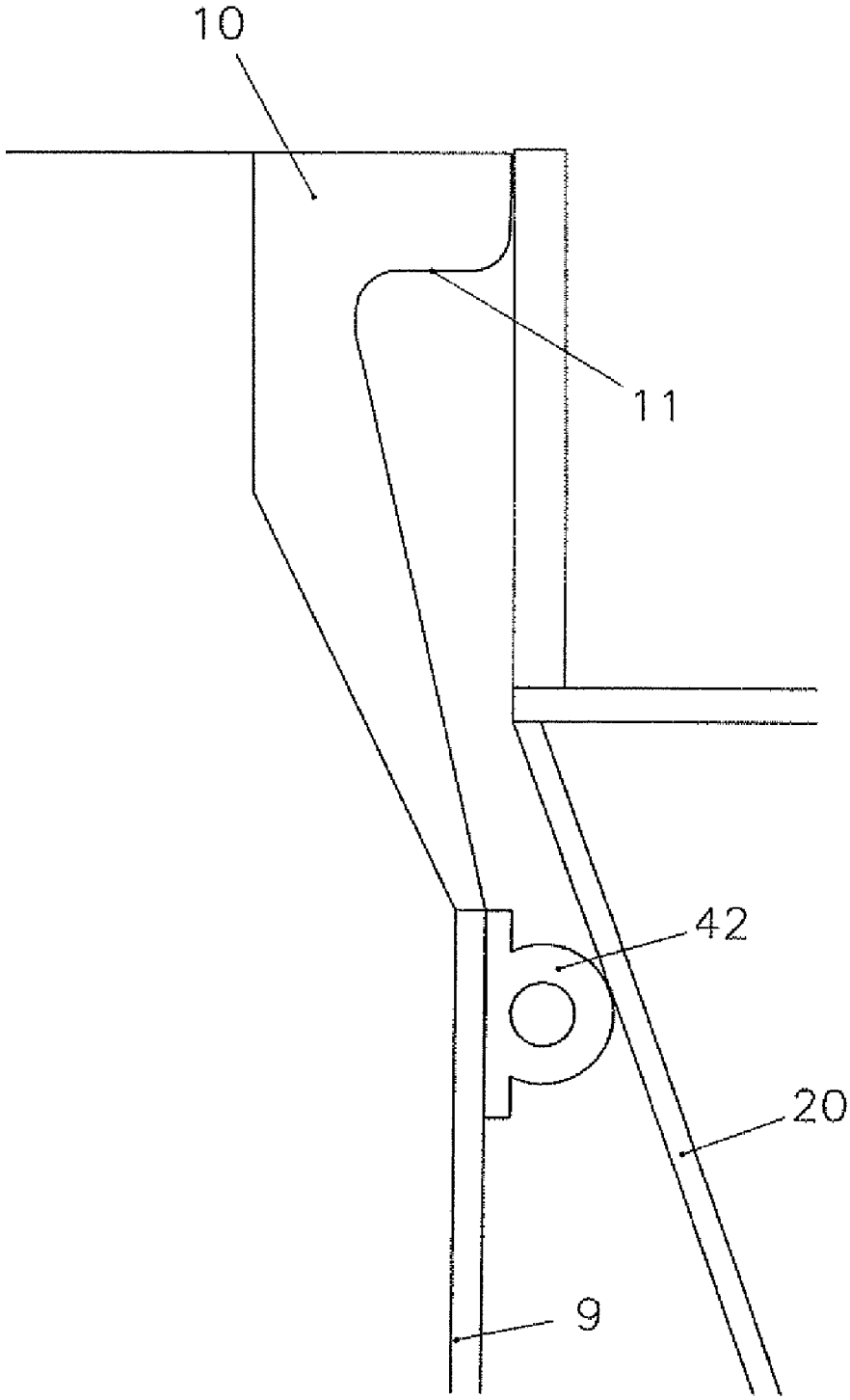
FIG. 4 shows detail IV of FIG. 1 at a larger scale.

The buoy member 2 includes a conical outer casing 8 and a central cylinder 9 accommodating the passages 6 and installed risers 7. The central cylinder 9 projects upwardly with respect to the outer casing 8 and supports a locking ring 10 with a locking shoulder 11 at its upper end. The locking ring 10 and locking shoulder 11 are shown in more detail in FIG. 4. Further the central cylinder 9 includes a riser connection deck 12 at its upper side. This deck 12 is located below the locking ring and supports the installed risers 7. It is noted that a plurality of ballast compartments are provided within the outer casing 8 of the buoy member 2, which compartments can be used for ballast and trimming purposes to compensate for installed risers, eccentric resultant loads from risers, and any other asymmetric loads. It is further note that the riser connection deck 12 is not necessarily located in the upper half of the buoy member 2 as in the embodiment shown.

The moonpool 4 is provided by means of a casing 13 mounted in the vessel 1, for example in its bow portion. As shown in FIGS. 1 and 2 the casing 13 includes a cylindrical shaft 14 and a cone 15. Of course the casing 13 may have a different construction. By way of example it is noted that the cylindrical shaft 14 can extend from keel level to approximately 18 m above keel level, and the cone 15 can have a height of 6.5 m. At the upper end of the cone 15 a main bearing assembly 16 is supported, which will be further described hereinafter. Ventilation of the moonpool 4 is arranged by means of a plurality of ventilation ducts 17, one of which is schematically shown in FIGS. 1 and 2.

The turret structure 3 comprises a top section 18, a central cylindrical section 19 and a bottom section 20 made as a receptacle cone. The shape of the receptacle cone 20 corresponds to the cone shape of the conical outer casing 8 of the buoy member 2 so that the buoy member 2 can be fittingly received within the receptacle cone 20 of the turret structure 3. In this manner the buoy member 2 will be aligned with the axis of turret structure 3 during the connection operation as will be described later.

In the embodiment shown, the turret structure 3 further comprises a multi-deck turntable 21 carrying a number of conduits 22 which extend downwardly from the turntable 21 into the turret structure 3. As an alternative the turntable 21 may comprise a single deck only. The conduits 22 are arranged such that their pitch and radial distance from the axis of the turret structure 3 correspond to the same of the passages 6 and risers 7. At the lower end the conduits 22 are terminated by termination structures including a connection flange. A swivel 21A is mounted on the turntable 21 connecting at least some of the conduits 22 to piping of the vessel 1 not further shown. Some conduits 22 can be commingled prior to entering the swivel 21A. The turntable 21 is supported on the main bearing assembly 16 in a manner allowing rotation with respect to the turret structure 3. In this manner, the conduits 22 can be aligned with the installed risers 7 or passages 6 when the buoy member 2 is received and locked in the receptacle cone 20 of the turret structure 3.

Figure 6:
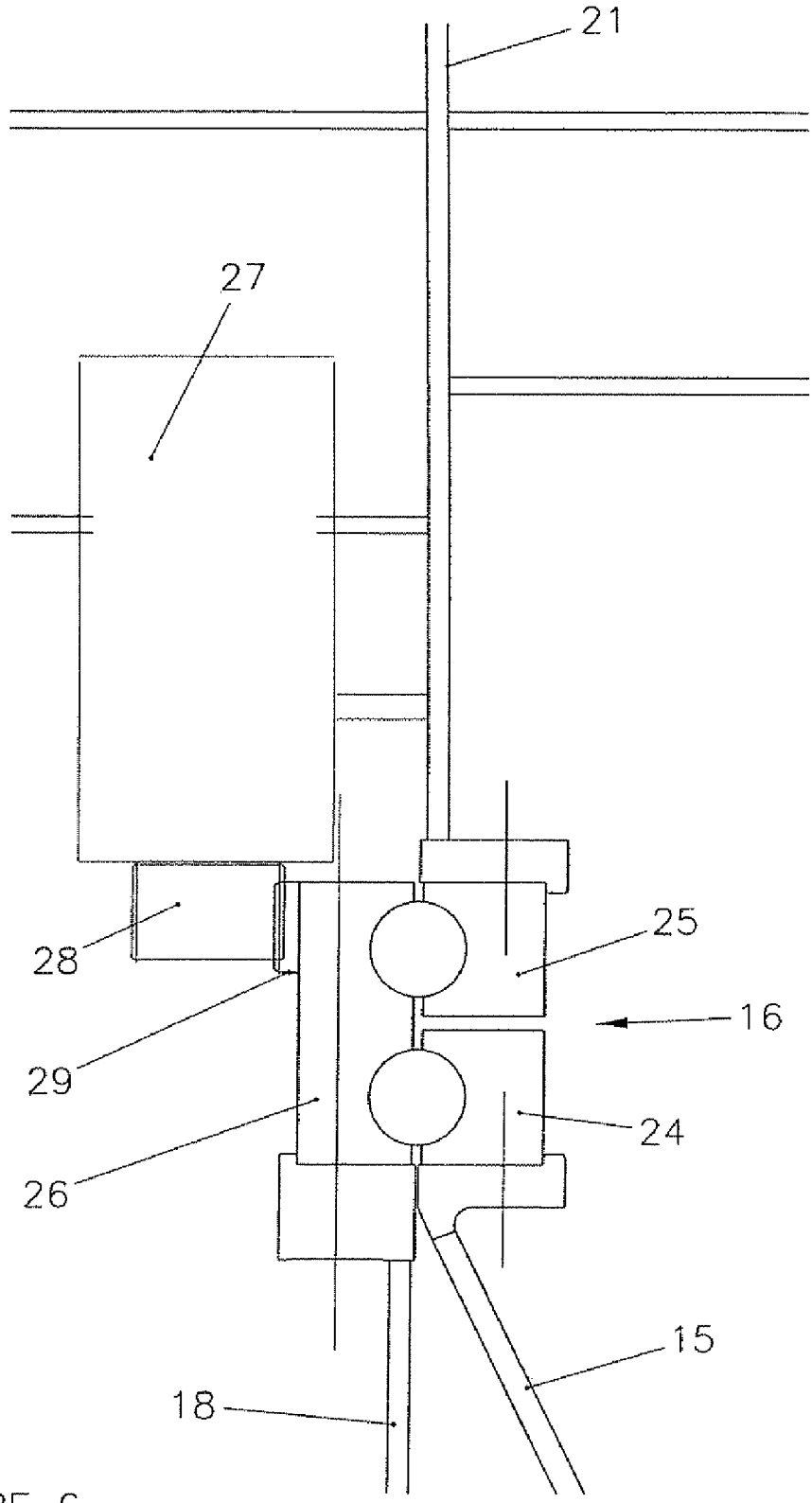
FIG. 6 shows detail VI of FIG. 1 at a larger scale in a very schematic manner.

As shown in more detail in FIG. 6 the main bearing assembly 16 includes first, second and third mutually movable parts 24, 25 and 26. The first movable part is connected to cone 15 of the casing 13, whereas the second movable part 25 is connected to the turntable 21. The third movable part 26 is connected to the top section 18 of the turret structure 3. It will be understood that the main bearing assembly 16 with the three mutually movable parts is only shown by way of example in a very schematical manner in FIG. 6. The bearing assembly 16 can be made for example as an axial/radial, double rotating three race roller bearing assembly. However, other types of bearing assemblies can be used. In practice, each movable part 24-26 may consist of several bearing sections which are interconnected to provide the respective movable part.

The turntable 21 supports a motor 27 as drive means to rotate the turntable 21 with respect to the turret structure 3. This motor 27 drives a pinion 28 engaging a tooth rack 29 which is mounted on the inner side of the third movable part 26 of the main bearing assembly 16. At the lower end the turret structure 3 is supported by a lower radial sliding bearing 30 (FIG. 1). Further, braking or locking device (not shown) 13 provided to lock the turntable 21 with respect to the turret structure 3 during normal operation of the vessel 1. During normal operation the vessel 1 can weathervane around the turret structure 3 anchored to the seabed through the buoy member 2.

The buoy member 2 is locked in the receptacle cone 20 by means of the locking ring 10 with its annular locking shoulder 11 through cooperation with locking devices 31 mounted in the central cylindrical section 19 of the turret structure 3. These locking devices 31 are schematically shown in more detail in FIG. 5A-5E. As shown the locking devices 31 comprise a plurality of locking fingers 32 regularly distributed around the annular locking shoulder 11 of the buoy member 2. Each locking finger 32 is rotatably supported in the central cylindrical section 19 and is movable between the locking position shown in FIG. 5A, and a rest position shown in FIG. 5B. In the locking position, the locking fingers 32 engage the annular locking shoulder 11 and in the rest position, the annular locking shoulder 11 can pass the locking fingers. Each locking finger 32 is operated by means of a push rod 33 provided with an operating mechanism 34 such as an actuator (e.g. electric, hydraulic and/or pneumatic) mounted at its upper end. Alternative constructions are possible with push or pull rods.

Figures 5A, 5E:
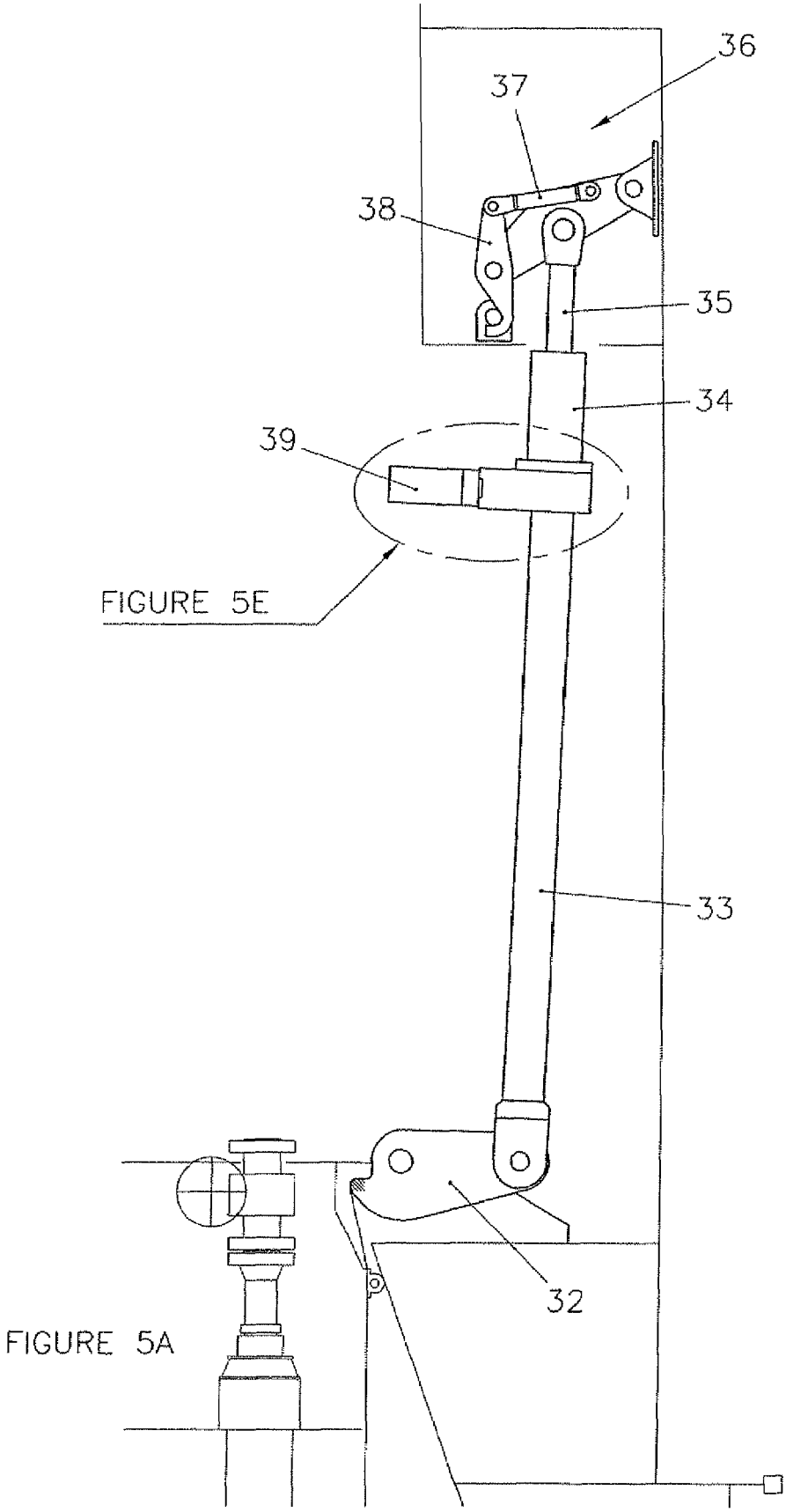
FIGS. 5A-5E show detail V of FIG. 1 at a larger scale to explain the operation of the locking device.
Figure 5B:
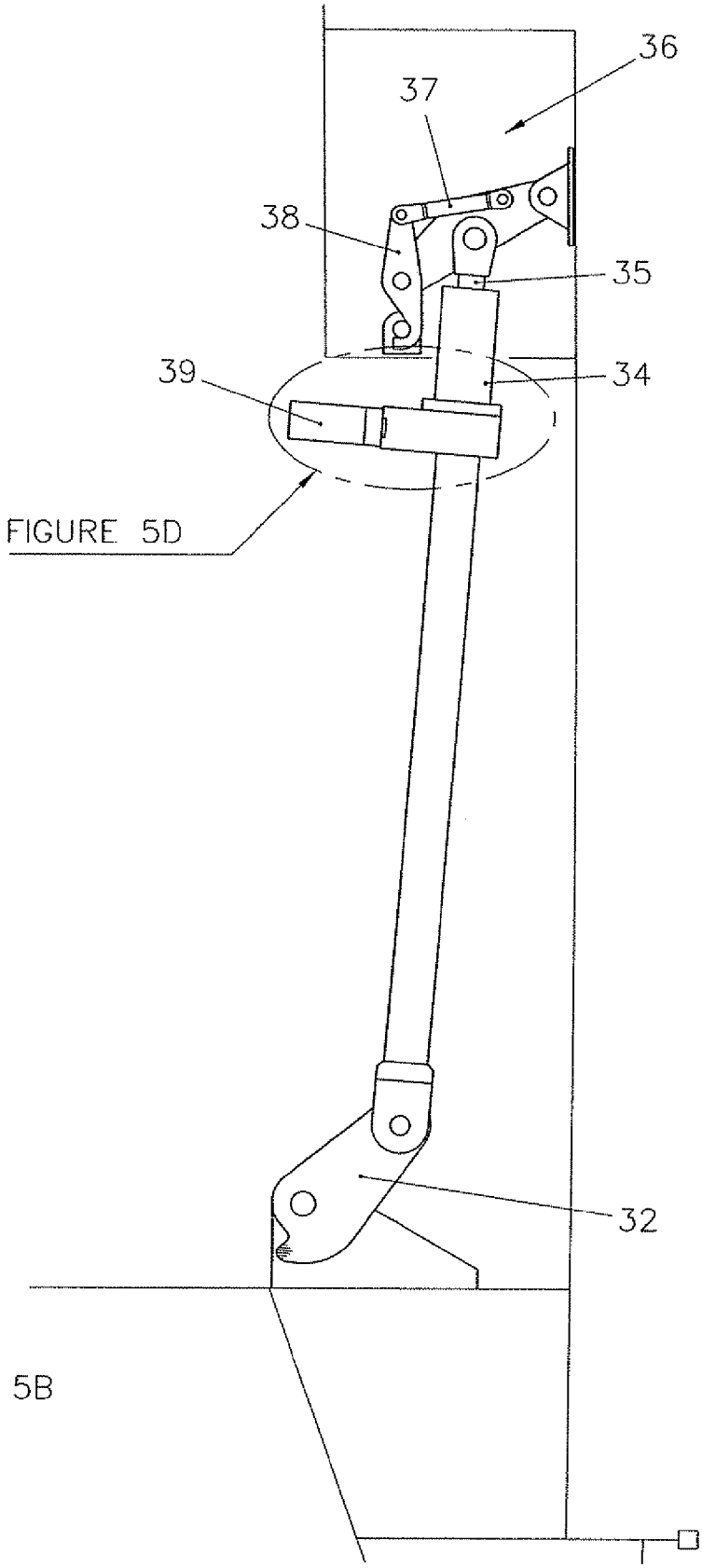
Figure 5C:
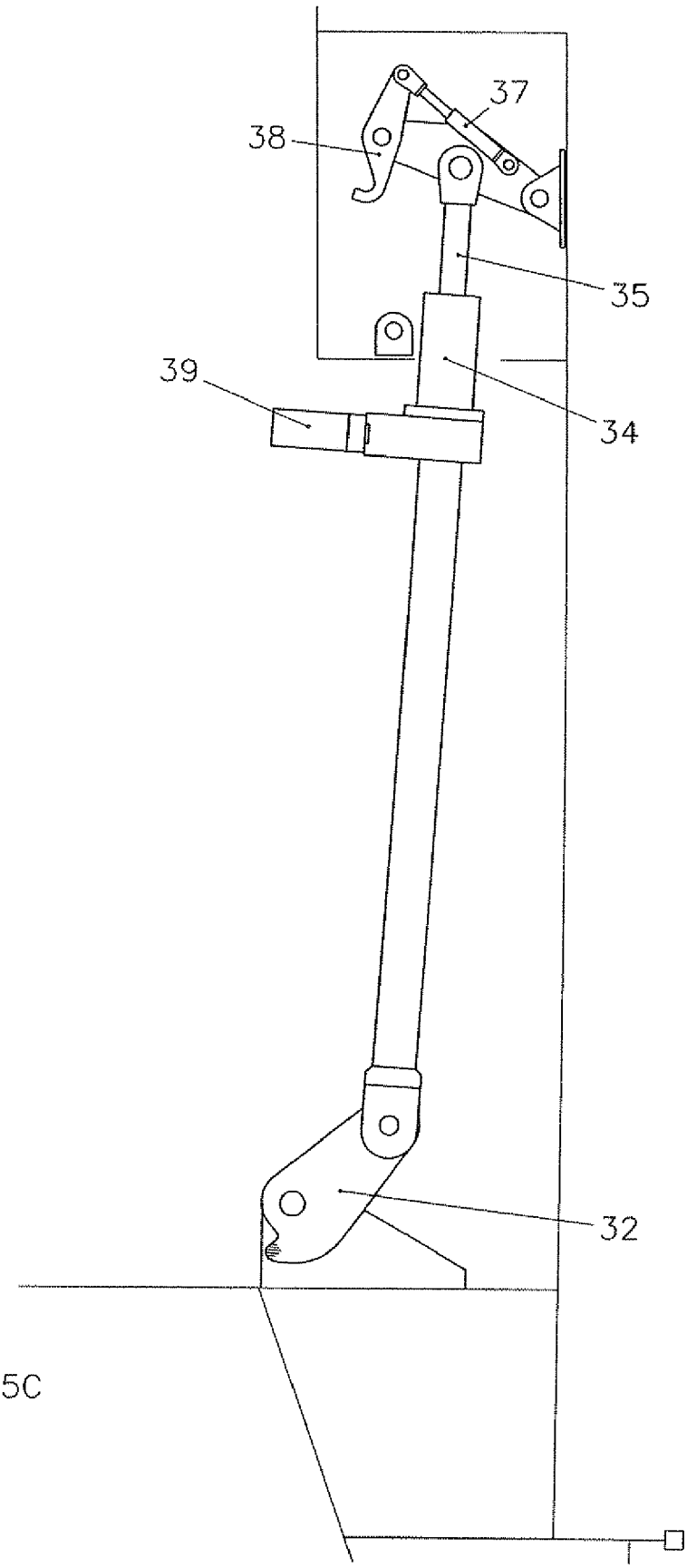
Figure 5E:
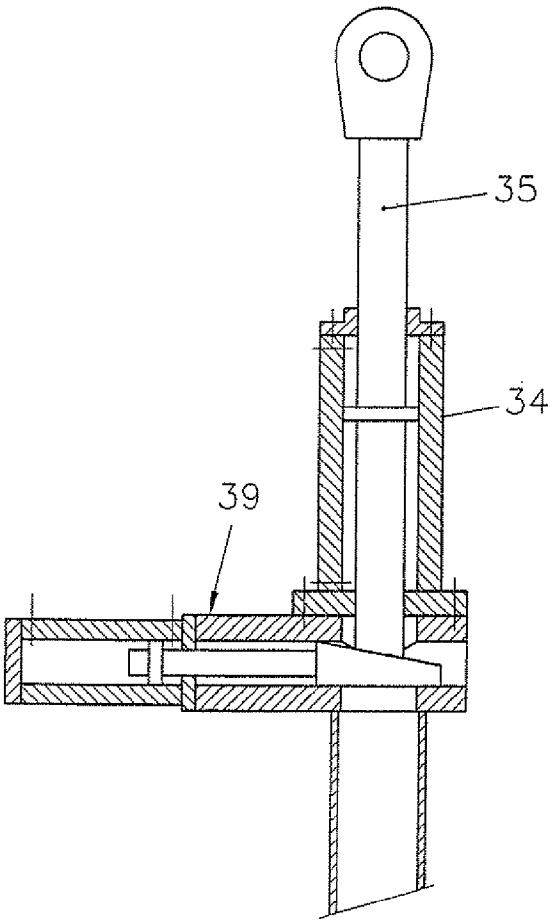
Figure 5D:
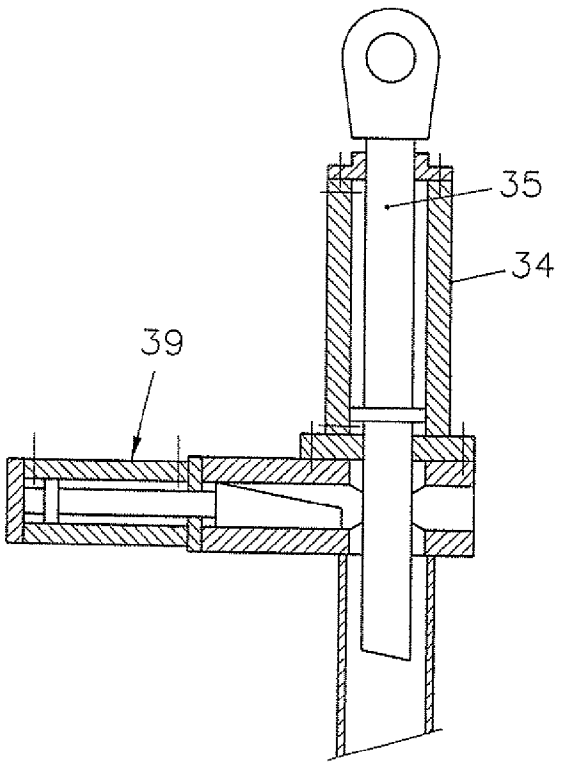

This operating mechanism 34 is shown in more detail in FIGS. 5D and 5E by way of example. A piston part 35 is connected at its upper end to a fail-safe mechanism 36 allowing movement of the locking fingers 32 from the locking position of FIG. 5A to the rest position in case the operating mechanism 34 fails to operate. In that case, a cylinder-piston assembly 37 releases a latch 38 so that the locking fingers 32 can rotate to the rest position of FIG. 5C due to the downward forces on the buoy member 2.

In the embodiment illustrated in FIG. 5, the operating mechanism 34 comprises a hydraulically operated locking member 39 shown in detail in FIGS. 5D and 5E. In FIG. 5E the hydraulic operating mechanism 34 is in its position in which the locking fingers 32 engage the annular locking shoulder 11. In this position of the piston part the locking member 39 can be moved from its rest position of FIG. 5D into the locking position of FIG. 5E, whereafter the hydraulic pressure can be removed from the hydraulic operating mechanism 34.

The disconnectable mooring system described above is used in the following manner for mooring the vessel 1. The mooring buoy member 2 is floating at the predetermined equilibrium depth below seawater level with all mooring lines 5 fully installed. Prior to arrival of the vessel 1, all or some risers 7 are installed, so that the buoy member 2 is ready for retrieval into the vessel 1 at its arrival. Upon arrival of the vessel 1 at the location of the submerged buoy member 2, a hoist chain 40 is picked up by the vessel 1 in a suitable manner. As known per se, the hoist chain 40 is connected by a suitable cable to a floater not shown to pick up the hoist chain. When it has been picked up, the hoist chain 40 is connected to a tensioning system or wildcat winch unit 41, which is mounted in the turntable 21. This situation is schematically shown in FIG. 2.

During a pull-in operation the tensioning system 41 ensures that the buoy member 2 is pulled against the receptacle cone 20 of the turret structure 3 by a predetermined tension load. This load ensures that a seal 42 provided on the buoy member 2 is pressed against the receptacle cone 20 with a predetermined force so that the inner side of the turret structure 3 above the seal 42 is sealed and ingress of seawater is prevented. In the embodiment shown the seal 42 can be used more than once. It is also possible to use a disposable seal means. Further, it is noted that the receptacle cone 20 can be provided with a seal means or both the buoy member and receptacle cone.

Once the buoy member 2 is in its position within the receptacle cone 20, the operating mechanisms 34 of the locking fingers 32 are activated to lock the buoy member 2 within the receptacle cone 20. When all locking fingers 32 have engaged the annular locking shoulder 11, the operating mechanisms 34 are switched into the passive holding mode by bringing the locking member 39 in the position of FIG. 5E. At that time the buoy member 2 is fully locked within the receptacle cone 20 of the turret structure 3 and all mooring loads are transferred by the turret structure 3 though the bearings 16, 30 into the hull of the vessel 1.

Figure 3A:
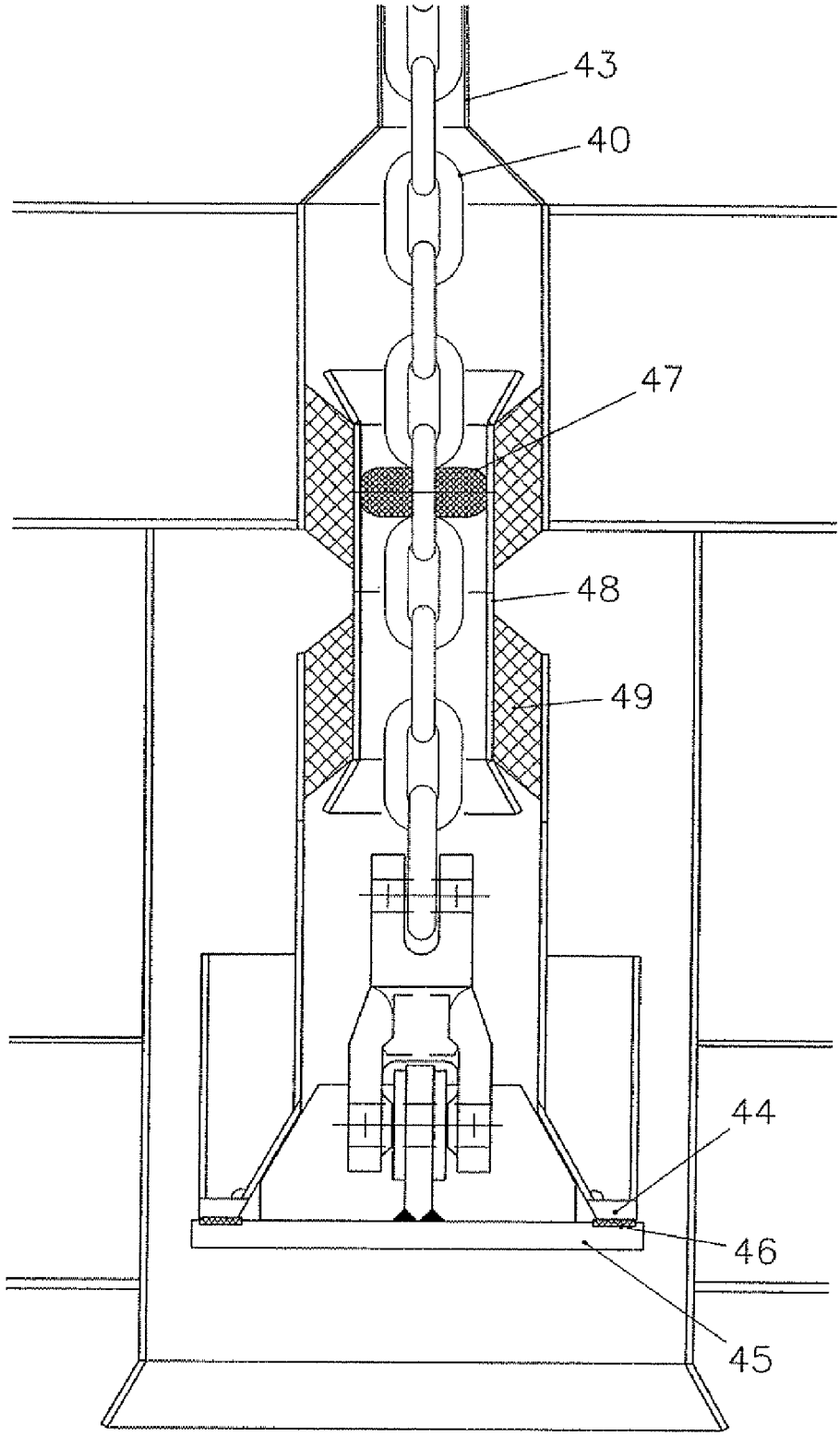
FIGS. 3A and 3B show detail III of FIG. 1 at a larger scale with the hoist chain in different positions.
Figure 3B:
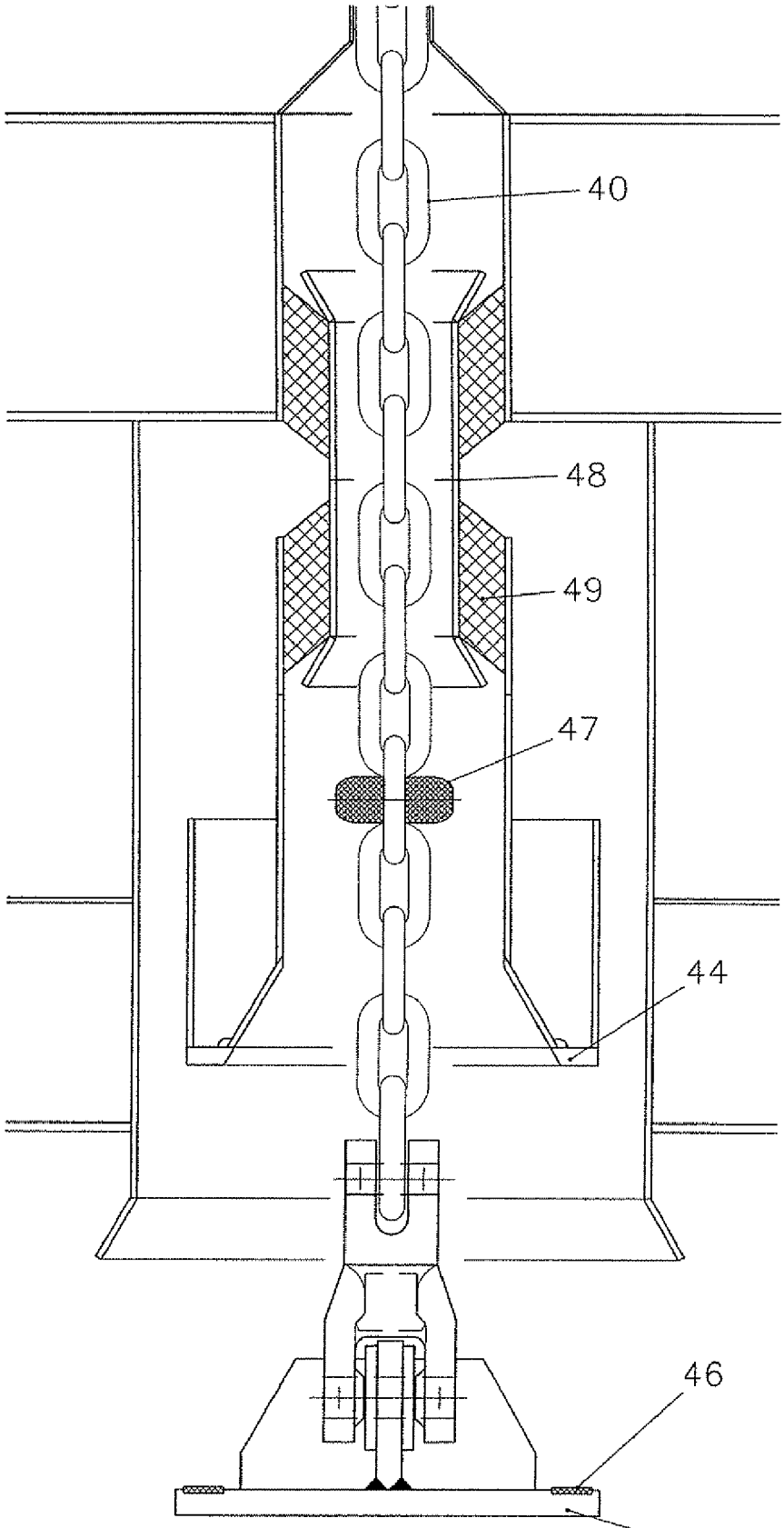

The buoy member 2 is provided with a central guide tube 43 for the hoist chain 40 and this central guide tube is provided with an annular flange 44 at its lower end as shown in more detail in FIGS. 3A and 3B. The hoist chain 40 carries at its lower end a stopper plate 45 with a sealing ring 46. The hoist chain 40 is provided with a sealing member 47. In FIG. 3B, the stopper plate 45 is disengaged from the annular flange 44 and during a pull-in operation, the stopper plate 45 will move from the position of FIG. 3B into the position of FIG. 3A, wherein the sealing ring 46 of the stopper plate 45 sealingly engages the annular flange 44 of the guide tube 43. Further, the sealing member 47 will sealingly engage the inner side of a coupling tube part 48. In this manner, seawater ingress through the central guide tube 43 to the inner side of the turret structure 3 is prevented.

As can be seen in FIGS. 3A and 3B the annular flange 44 is connected to the central guide tube 43 through a shock absorber 49. This shock absorber 49 absorbs peak loads during a pull-in operation.

When the buoy member 2 is fully locked in its position in the receptacle cone 20, seawater which is trapped inside the turret structure 3 can be disposed to the sea by starting a bilge pump (not shown) which is mounted in the turret structure. A further pump can be provided to dispose of any seawater leaked through the sealing provisions described above.

During the pull-in operation, the cooperation between the conical outer casing 8 of the buoy member 2 and the receptacle cone 20 will automatically guarantee an axially aligned position of the buoy member 2 with respect to the axis of the turret structure 3. However, it is not necessary to align the passages 6 or installed risers 7 of the buoy member 2 with the conduits 22 accommodated in the turret structure 3. The buoy member 2 can be randomly positioned with respect to the conduits 22. When the buoy member 2 is locked in the receptacle cone 20, the conduits 22 can be aligned with the passages 6 and any installed risers 7 by rotating the turntable 21 until corresponding conduits 22 are opposite of corresponding risers 7. After aligning the conduits 22 and risers 7, the physical connections between termination structures 50 and 51 of the conduits 22 and risers 7 respectively, can be made. These termination structures may comprise valves to close and open the conduits and risers.

As can be seen in FIG. 2, the termination structure 51 of a riser 7 includes a connection flange 52 which is located below the upper end of the locking ring 10, so that the connection flanges 52 are protected by the locking ring 10 during connecting/disconnecting operations. Rotation of the turntable 21 with the conduits 22 is possible without any contact between the connection flanges 52 and connection flanges 53 of the termination structures 50 of the conduits 22.

Figure 7B:
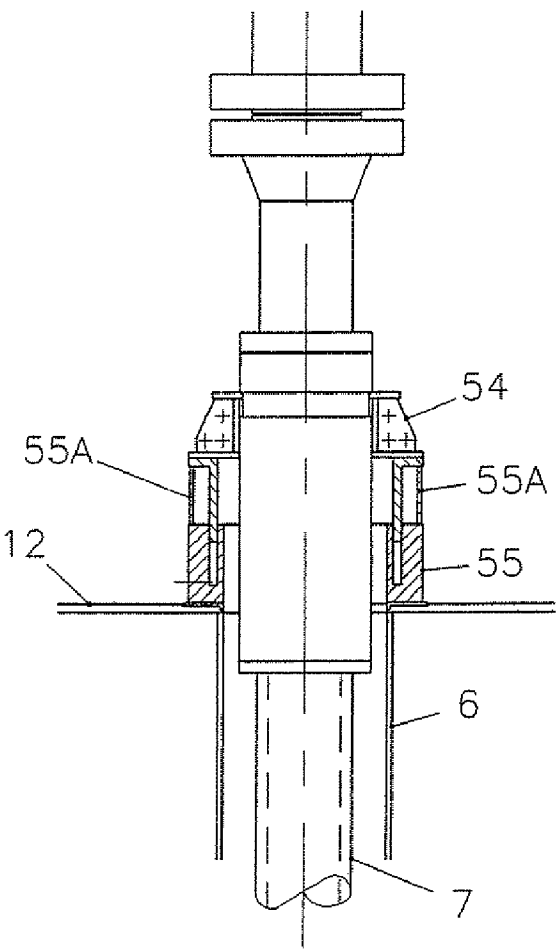
FIGS. 7A and 7B show detail VII of FIG. 1 at a larger scale with the riser in its rest position and work position, respectively.
Figure 7A:
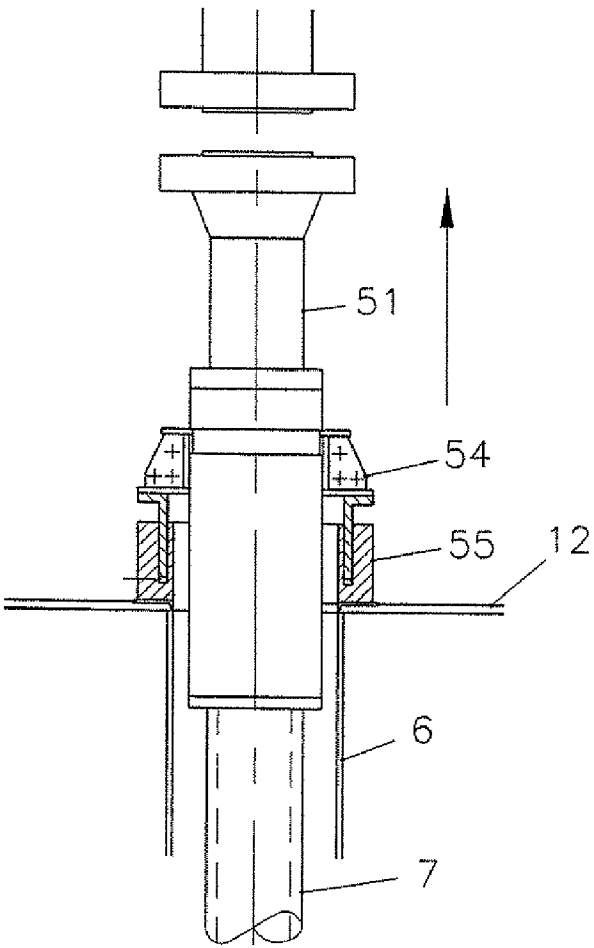

Before making the physical connections between risers and conduits, the connection flanges 52, 53 can be prepared to guarantee a fully sealed connection. Each riser 7 is supported on the riser connection deck 12 by a support 54 as shown in FIGS. 7A and 7B at a larger scale. Each support 54 is movable up and down by a jack (e.g. electric, hydraulic and/or pneumatic) 55 shown in rest position in FIG. 7A and in a work position in FIG. 7B. To make the physical connections, the supports 54 are moved upwardly by the jacks 55. When the connection flanges 52 of the termination structures 51 are at the right height, the movable supports 54 are locked in their raised position by inserting locking elements 55A, such as ring segments. In the embodiment illustrated, this allows release of the hydraulic pressure on the hydraulic jacks 55.

As an alternative the lower ends of the conduits 22 can be movable up and down between a rest position and work position to allow coupling of the connection flanges 52, 53. As a further alternative it is possible that one or both of the termination structures 50, 51 comprises a line connector which can be remotely operated. Such a line connector provides movability up and down of the connection flanges 52 and/or 53. The line connectors can be made as flowline connectors or electro/hydraulic/pneumatic line connectors depending on the type of the corresponding riser. Further the line connector may include remotely or automatically operated shutoff valves. It is noted that the line connectors can be operated individually or as a group.

However, such a construction requires a movable part sealed with respect to the fluid or gas transporting riser or conduit. Therefore, movement of the complete riser 7 or conduit lower end is preferred. In a still further alternative embodiment the risers 7 and/or conduit lower ends can be moved up and down in groups of risers or conduits or all together to make the physical connections between the connection flanges 52, 53.

It is noted that the inner side of the turret structure can be filled with nitrogen gas and/or mechanical ventilation can be provided for prevention of explosion risks in any desired manner known per se. As can be seen in FIG. 1, all termination structures 50, 51 are fully accessible through the turret structure 3 when the buoy member 2 is in its locked position in the receptacle cone 20. Due to the movable support at each passage 6, the construction of the disconnectable mooring system allows installation of risers 7 at a later stage while maintaining the locked position of the buoy member 2 within the receptacle cone 20. This means that installation of further risers in future is possible without disconnection of the buoy member 2.

For disconnecting the buoy member 2 from the turret structure 3, the production must be stopped and in case the termination structures 50, 51 include valves, these valves must be closed. Any fluids and gasses that may release after disconnection have to be drained in advance. The jacks 55 are operated to lower the risers 7 to their rest position of FIG. 7A. Further, the operating mechanisms 34 are operated to move the locking fingers 32 from the locking position of FIG. 5A into the rest position of FIG. 5B. Prior to release of the locking fingers 32, the pressure difference between the inner side of the turret structure 3 and the moonpool 4 is compensated by flooding the inner side of the turret structure 3 with seawater to such a level that a light overpressure exists to guarantee a smooth disconnect operation. After bringing the locking fingers 32 to their rest position, the buoy member 2 is lowered to its floating equilibrium depth by the tensioning system 41 and when the upper end of the hoist chain 40 has reached the tensioning system, the floater is connected to the hoist chain and also a stopper plate (not shown) to support the hoist chain on the upper end of the central guide tube 43.

To allow the buoy member 2 to be lowered by the tensioning system 41, the locking fingers 32 can also be unlocked by means of the fail-safe mechanism 36 as described above. In case of unforeseen conditions the buoy member 2 can be lowered in an uncontrolled manner, wherein the tensioning system 41 is not used.

Figure 8:
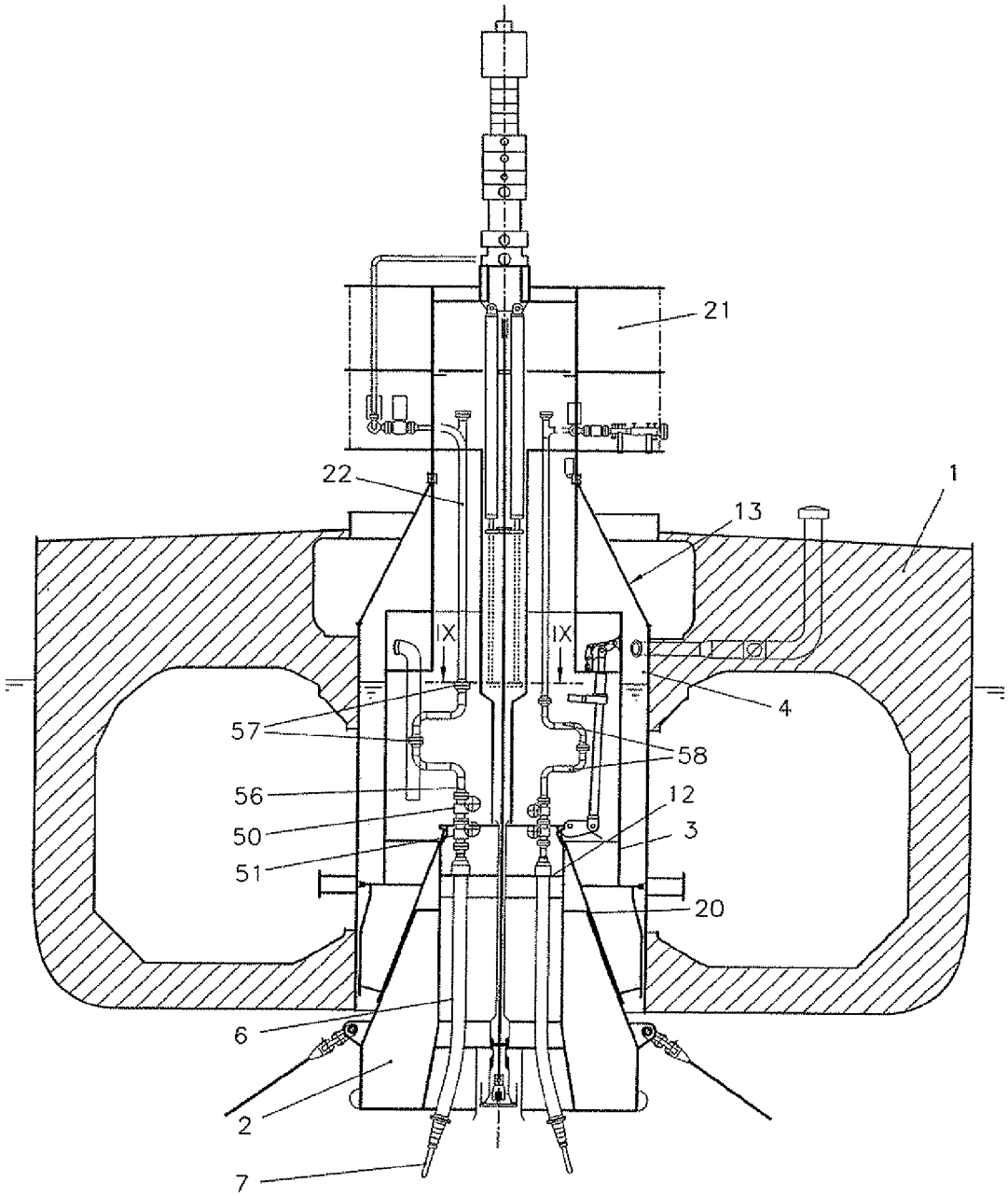
FIG. 8 shows a cross-section of a vessel comprising a second embodiment of the disconnectable mooring system, wherein the mooring buoy member is received and locked in the receptacle of the turret structure.
Figure 9:
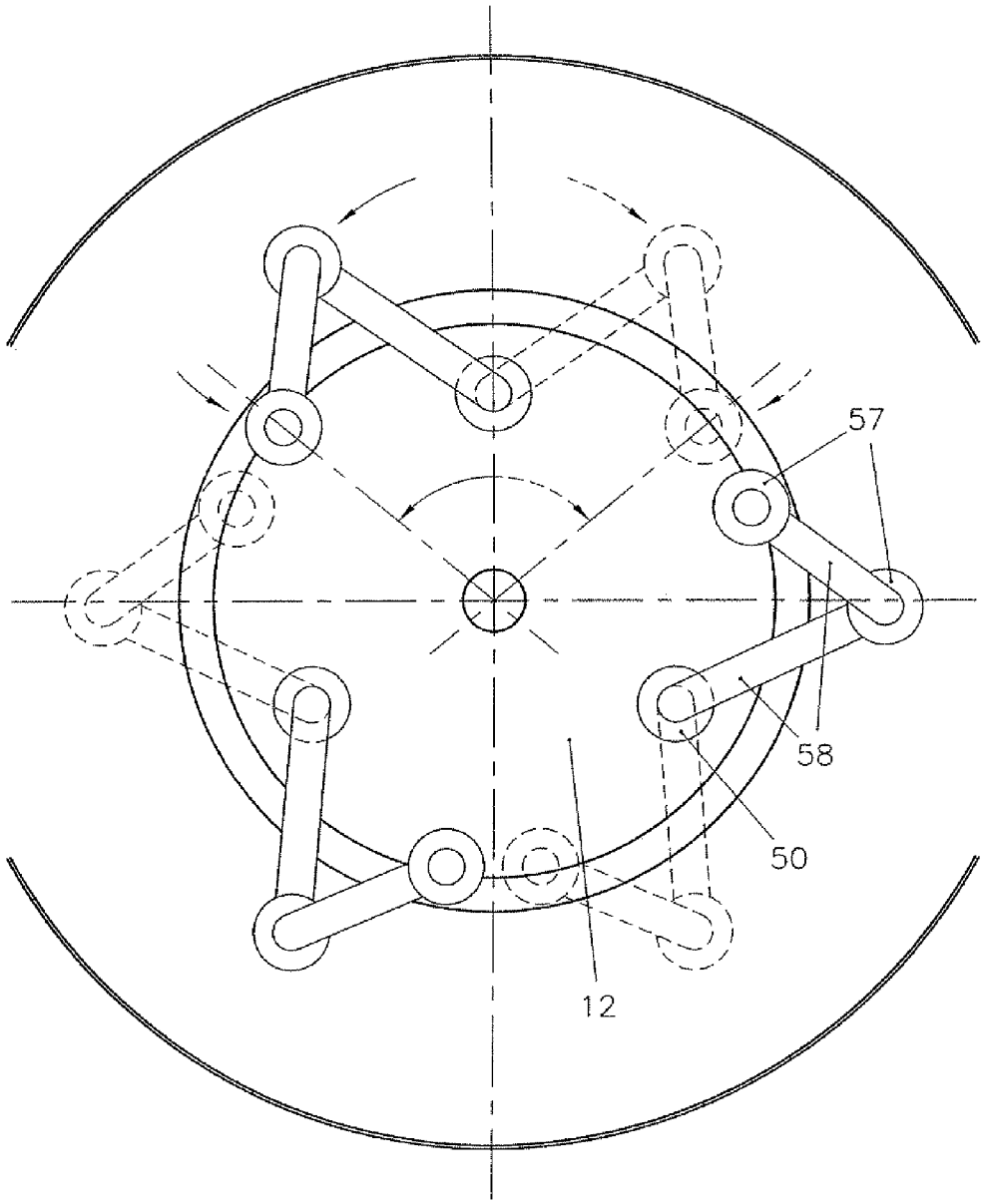
FIG. 9 is a schematically shown cross-section according to the line IX-IX of FIG. 8.

FIG. 8 schematically shows an embodiment of the disconnectable mooring system described, which mainly corresponds to the embodiment shown in FIGS. 1 and 2. Corresponding parts are indicated by the same reference numerals. In this case the conduits 22 each are provided with a lower part 56 carrying the termination structure 50, which lower part 56 is movable at least in a horizontal plane. This movable lower part 56 allows an individual alignment of each termination structure 50 with respect to the termination structure 51 of the corresponding riser 7. In this manner construction tolerances in pitch and radial position of the passages 6 and conduits 22 can easily be compensated. Moreover, in this embodiment the turret structure 3 and turntable 21 can be made as one assembly rotatably supported in the moonpool 4 by a main bearing assembly which may be made with two mutually movable parts. One part of this main bearing assembly carries the turntable/turret structure assembly and the other part is mounted on the upper end of the casing 13. Rotation of the turntable/turret structure assembly is possible by a drive such as a motor (e.g. electric, hydraulic and/or pneumatic) rotating this assembly with respect to the vessel 1. Further a brake assembly or locking means can be provided to temporarily lock the turntable/turret structure assembly with respect to the vessel 1. This drive means and brake assembly is normally disengaged so that the vessel can weathervane around the turret structure anchored to the seabed through the buoy member 2.

In the embodiment shown the movability of the lower parts 56 is obtained by means of an intermediate part comprising two swivel joints 57 and two bend parts 58. It will be understood that other constructions are possible to obtain the required flexibility of the conduits. As indicated in the cross-section of FIG. IX the lower part can be moved along an angle of approximately 45° to the left (full lines) and right (dashed lines) from its position aligned with the conduit upper parts. This angle is only an example and other ranges of movability are of course possible.

In case of an embodiment wherein the turntable and turret structure are one assembly, a rough prepositioning of the turret structure with respect to the buoy member 2 is necessary during a mooring operation. This prepositioning is possible by orienting the vessel 1 with respect to the buoy member 2 and/or rotating the turret structure 3 and turntable 21 by the drive means with respect to the vessel 1. When the buoy member 2 is received and locked in the receptacle cone 20, a final alignment is obtained by moving the lower parts 56.

It is noted that the features of the disconnectable mooring system described can be applied independently in different types of mooring systems. For example, the movable support of the risers can be applied independent of the use of a rotatable turntable and/or the locking means and/or the arrangement of the termination structures in the turret structure.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims. In addition, workers skilled in the art will recognize that changes may be made in form and detail without departing from the spirit and scope of the in ventive concepts described herein.

The invention claimed is:

1. A disconnectable mooring system for a vessel, comprising a mooring buoy member and a turret structure mounted in a moonpool of the vessel, the mooring buoy member being anchorable to the seabed and having a plurality of passages each adapted to receive a riser, the turret structure having a receptacle for receiving the buoy member and a lock adapted to lock the buoy member in the receptacle, the turret structure accommodating a plurality of conduits to be connected to risers installed in passages of the buoy member, wherein the turret structure is rotatably supported in the moonpool of the vessel by a first bearing assembly, wherein the buoy member is provided with a conical outer casing and the receptacle of the turret structure has a cone shape corresponding to the conical outer casing of the buoy member, the turret structure comprising a turntable carrying the conduits to be connected to the risers, wherein the turntable is supported on the turret structure with a second bearing assembly such that the turntable is rotatable with respect to the turret structure to align the conduits with the risers when the buoy member is received and locked in the receptacle of the turret structure.

2. The disconnectable mooring system according to claim 1, wherein the first bearing assembly comprises first and third mutually movable parts and the second bearing assembly comprises second and third movable parts, wherein the first movable part is connected to the vessel, the second movable part is connected to the turntable, and the third movable part is connected to the turret structure.

3. The disconnectable mooring system according to claim 2, wherein the turntable supports a drive adapted to rotate the turntable with respect to the turret structure.

4. The disconnectable mooring system according to claim 1, wherein each conduit comprises a lower part movable with respect to the turret structure to align the lower part with the corresponding riser.

5. A disconnectable mooring system for a vessel, comprising a mooring buoy member and a turret structure mounted in a moonpool of the vessel, the mooring buoy member being anchorable to the seabed and having a plurality of passages each adapted to receive a riser, the turret structure having a receptacle for receiving the buoy member and a lock adapted to lock the buoy member in the receptacle, the turret structure comprises a turntable rotatably attached to the turret structure with a second bearing assembly, the turntable accommodating a plurality of conduits to be connected to risers installed in passages of the buoy member, wherein the turret structure is rotatably supported in the moonpool of the vessel by a first bearing assembly, wherein the buoy member is provided with a conical outer casing and the receptacle of the turret structure has a cone shape corresponding to the conical outer casing of the buoy member, wherein each conduit comprises a lower part moveable with respect to the turret structure to align the lower part with the corresponding riser.

6. The disconnectable mooring system according to claim 5, wherein the turntable supports a drive adapted to rotate the turntable and turret structure with respect to the vessel.

7. The disconnectable mooring system according to claim 5 wherein the lower part of each conduit is connected to its upper part through a flexible intermediate part.

8. The disconnectable mooring system according to claim 5, wherein the buoy member comprises an upper end with an annular locking shoulder adapted to cooperate with the lock of the turret, said lock comprising a plurality of locking fingers distributed around the annular locking shoulder, each locking finger being movable by an actuator between a locking position engaging the annular locking shoulder and a rest position in which the annular locking shoulder can pass the locking fingers.

9. The disconnectable mooring system according to claim 8, wherein each actuator comprises a locking member to lock the actuator in the locking position to maintain the locking position without activation of the actuator.

10. The disconnectable mooring system according to claim 8 wherein each actuator comprises a fail-safe system to release the locking fingers.

11. The disconnectable mooring system according to claim 5, wherein means are provided to move each conduit or a group of conduits with respect to the corresponding riser(s) up and down between a rest position and a work position, wherein each riser is provided with a connection flange which is located below the upper end of the buoy member and above a riser connection deck of the buoy member.

12. This disconnectable mooring system according to claim 5, wherein each riser and conduit are provided with a termination structure at its upper and lower end, respectively, wherein at least one termination structure of a corresponding riser or conduit comprises a line connector which can be operated to move a connection flange of the riser or conduit up and down.

13. The disconnectable mooring system according to claim 5, wherein each riser or group of risers is supported in the buoy member by a support which is movable up and down between a rest position and a work position, wherein each riser is provided with a connection flange which is located below the upper end of the buoy member and above a riser connection deck of the buoy member in the support rest position and projects out of the upper end of the buoy member in the support work position.

14. The disconnectable mooring system according to claim 5, wherein a seal is provided between the buoy member and the receptacle cone of the turret structure to seal the inner side of the turret structure against seawater ingress when the buoy member is received and locked in the receptacle cone, wherein the passages and installed risers are accessible through the turret structure when the buoy member is received and locked in the receptacle of the turret structure.

15. The disconnectable mooring system according to claim 5, wherein the buoy member comprises a hoist element and a central guide tube for the hoist element, the central guide tube having an annular flange at its lower end and the hoist element at its lower end carrying a stopper plate adapted to sealingly engage the annular flange, the hoist element at its other end being adapted to be pulled in by a tensioning system of the vessel.

16. The disconnectable mooring system according to claim 15, wherein the hoist element is provided with a seal sealingly cooperating with the inner side of the central guide tube when the hoist element is pulled in and the stopper plate engages the annular flange.

17. The disconnectable mooring system according to claim 15, wherein the annular flange is connected to the central guide tube through a shock absorber.

18. The disconnectable mooring system of claim 5 and further comprising a vessel, the vessel having the turret structure.

19. A method for connecting a vessel to a mooring buoy member, the vessel comprising a turret structure having a receptacle for receiving the buoy member and a lock adapted to lock the buoy member in the receptacle, the mooring buoy member being anchored to the seabed and having a plurality of passages each adapted to receive a riser, the turret structure accommodating a plurality of conduits to be connected to risers installed in passages of the buoy member, the method comprising pulling the buoy member into the receptacle cone wherein a first bearing assembly allows the vessel and turret structure to rotate with respect to each other, operating the lock to lock the buoy member in the receptacle cone, and after locking the buoy member in the receptacle cone, aligning the conduits with the corresponding risers by rotating a turntable carrying the conduits utilizing a second bearing assembly that allows the turntable to rotate with respect to the turret structure.

20. The method according to claim 19, wherein aligning the conduits with the corresponding risers includes moving a lower part of each conduit with respect to its corresponding upper part.

21. A method for connecting a vessel to a mooring buoy member, the vessel comprising a turret structure having a receptacle for receiving the buoy member and a lock adapted to lock the buoy member in the receptacle wherein a first bearing assembly allows the turret structure and the vessel to rotate with respect to each other, the mooring buoy member being anchored to the seabed and having a plurality of passages each adapted to receive a riser, the turret structure comprises a turntable that accommodates a plurality of conduits to be connected to risers installed in passages of the buoy member wherein the turntable is supported on the turret structure with a second bearing assembly, the method comprising pulling the buoy member into the receptacle cone, operating the lock to lock the buoy member in the receptacle cone, rotating the turntable utilizing the second bearing assembly to substantially align the conduits with the risers and moving a lower part of each conduit with respect to its corresponding upper part to align the conduits with the corresponding risers.

22. The method according to claim 19 and further comprising after aligning the conduits with the risers, moving the risers with respect to the conduits to connect the conduits with the corresponding risers.

* * * * *